US010617163B1

(12) United States Patent
Conway

(10) Patent No.: US 10,617,163 B1
(45) Date of Patent: Apr. 14, 2020

(54) BRA STRAP HOLDERS

(71) Applicant: Candi Conway, Richmond, IN (US)

(72) Inventor: Candi Conway, Richmond, IN (US)

( * ) Notice: Subject to any disclaimer, the term of this patent is extended or adjusted under 35 U.S.C. 154(b) by 66 days.

(21) Appl. No.: 15/925,860

(22) Filed: Mar. 20, 2018

(51) Int. Cl.
*A41F 15/02* (2006.01)

(52) U.S. Cl.
CPC ..... *A41F 15/02* (2013.01)

(58) Field of Classification Search
CPC ..... A41F 15/02
USPC ..... 450/86
See application file for complete search history.

(56) References Cited

U.S. PATENT DOCUMENTS 1,398,160 A * 11/1921 Sparks ..... G08B 13/08 116/90
1,551,368 A * 8/1925 Cloud ..... A41F 15/02 24/326
1,589,228 A * 6/1926 Robb ..... A41F 15/02 24/532
1,628,962 A * 5/1927 Fletcher ..... A41F 15/02 24/346
1,664,716 A * 4/1928 Wiberg ..... A41F 15/02 24/543
1,707,402 A * 4/1929 Kintz ..... A41F 15/02 24/351
2,004,305 A * 6/1935 Bopea ..... A41F 15/02 24/305
2,154,329 A * 4/1939 Guillod ..... A41F 15/02 24/532
2,528,854 A * 11/1950 Burk ..... A41F 15/02 24/369
2,643,380 A * 6/1953 Blair ..... A41F 15/02 2/460
2,984,879 A 5/1961 Budd
3,046,991 A * 7/1962 Heberling ..... A41F 15/02 450/86
3,956,805 A * 5/1976 Stroh ..... A41F 15/02 24/505
5,060,348 A 10/1991 Moshier
5,803,792 A * 9/1998 Roush ..... A41F 15/007 2/267
5,935,044 A * 8/1999 Brewster ..... A41F 15/02 2/323
6,135,852 A * 10/2000 Young ..... A41F 15/02 2/268
6,135,853 A 10/2000 Hopson
9,113,668 B2 8/2015 Lembo
2002/0023319 A1 * 2/2002 Griffith ..... A41F 15/02 24/163 R
2009/0194568 A1 8/2009 Fraser

FOREIGN PATENT DOCUMENTS

CA 24688442 2/2008

* cited by examiner

*Primary Examiner* — Gloria M Hale
(74) *Attorney, Agent, or Firm* — Kyle A. Fletcher, Esq.

(57) ABSTRACT

The bra strap holder is configured for use with a bra strap. The bra strap holder is adapted for use with a person. The bra strap holder is a clip that holds the bra strap in a fixed position on the person. The bra strap holder comprises a chevron and a removable adhesive. The chevron attaches to the bra strap. The removable adhesive attaches the chevron to the person.

18 Claims, 3 Drawing Sheets

BRA STRAP HOLDERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including apparel, more specifically, a stay configured for use with the strap of a brassiere.

SUMMARY OF INVENTION

The bra strap holder is configured for use with a bra strap. The bra strap holder is adapted for use with a person. The bra strap holder is a clip that holds the bra strap in a fixed position on the person. The bra strap holder comprises a chevron and a removable adhesive. The chevron attaches to the bra strap. The removable adhesive attaches the chevron to the person.

These together with additional objects, features and advantages of the bra strap holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the bra strap holder in detail, it is to be understood that the bra strap holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bra strap holder.

It is therefore important that the claims be regarded as including such equivalent construction insofar as they do not depart from the spirit and scope of the bra strap holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
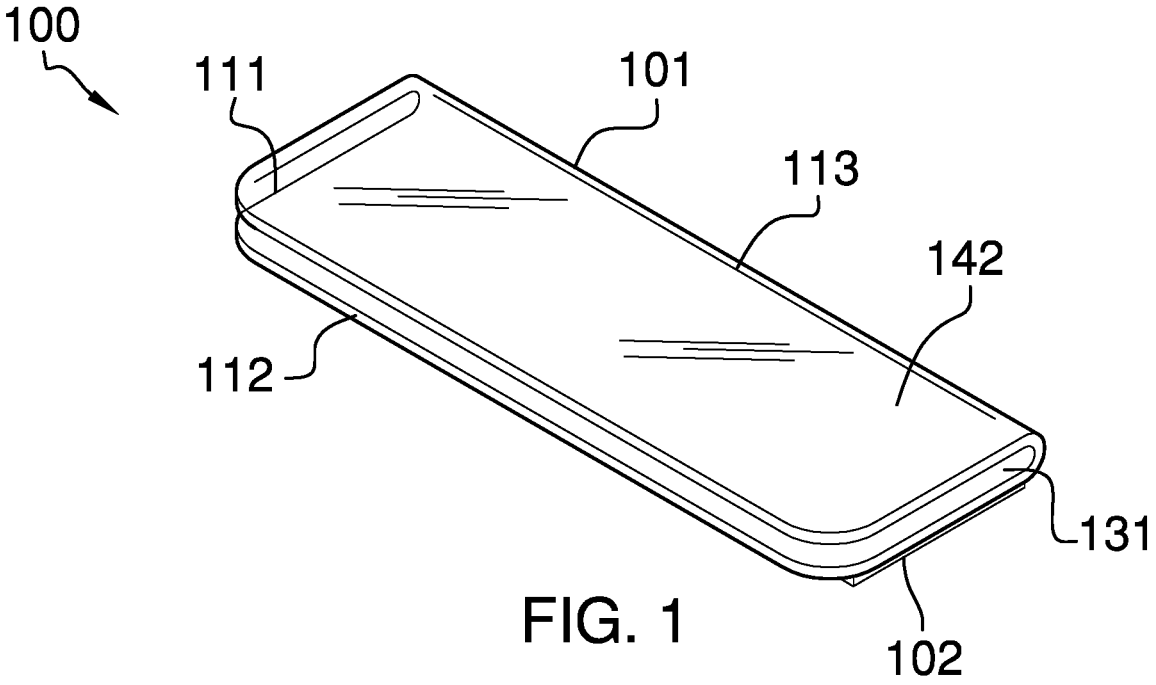
FIG. 1 is a perspective view of an embodiment of the disclosure.
Figure 2:
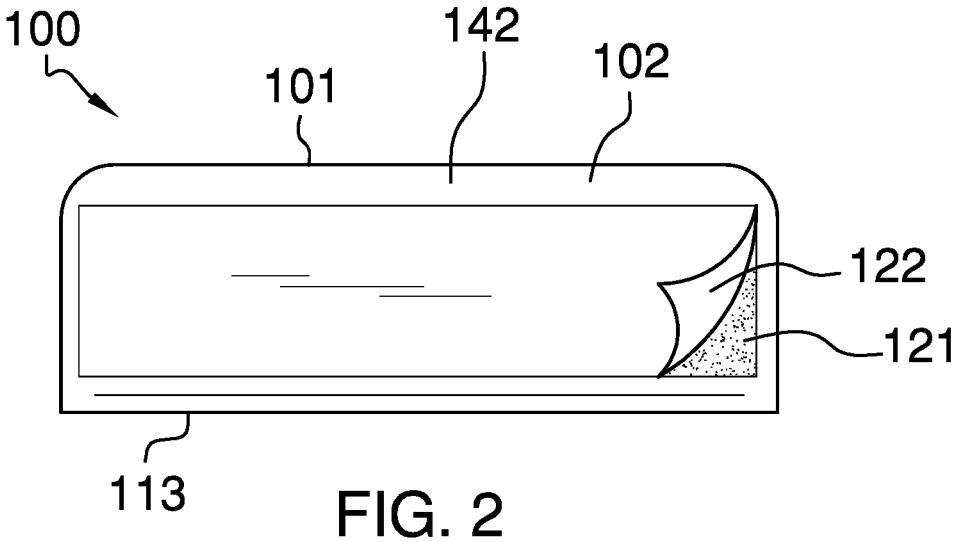
FIG. 2 is a bottom view of an embodiment of the disclosure.
Figure 3:
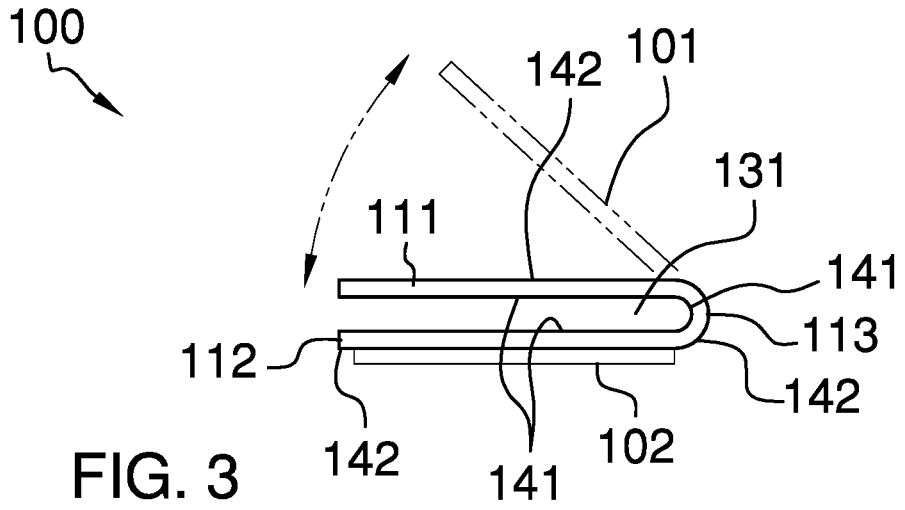
FIG. 3 is a side view of an embodiment of the disclosure.
Figure 4:
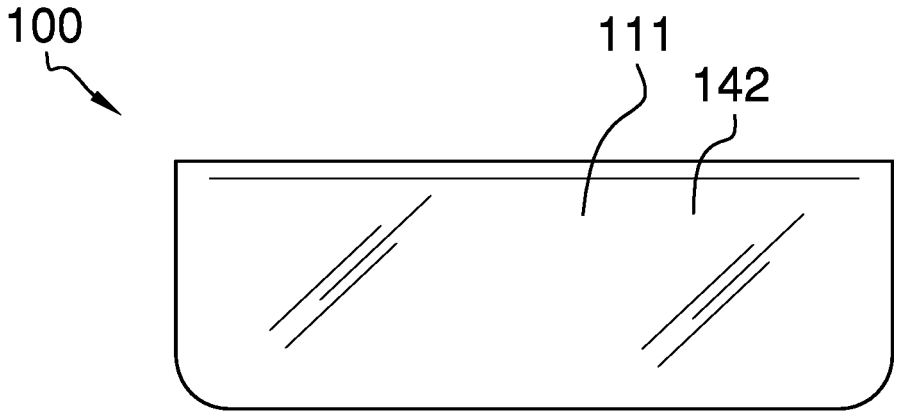
FIG. 4 is a top view of an embodiment of the disclosure.
Figure 5:
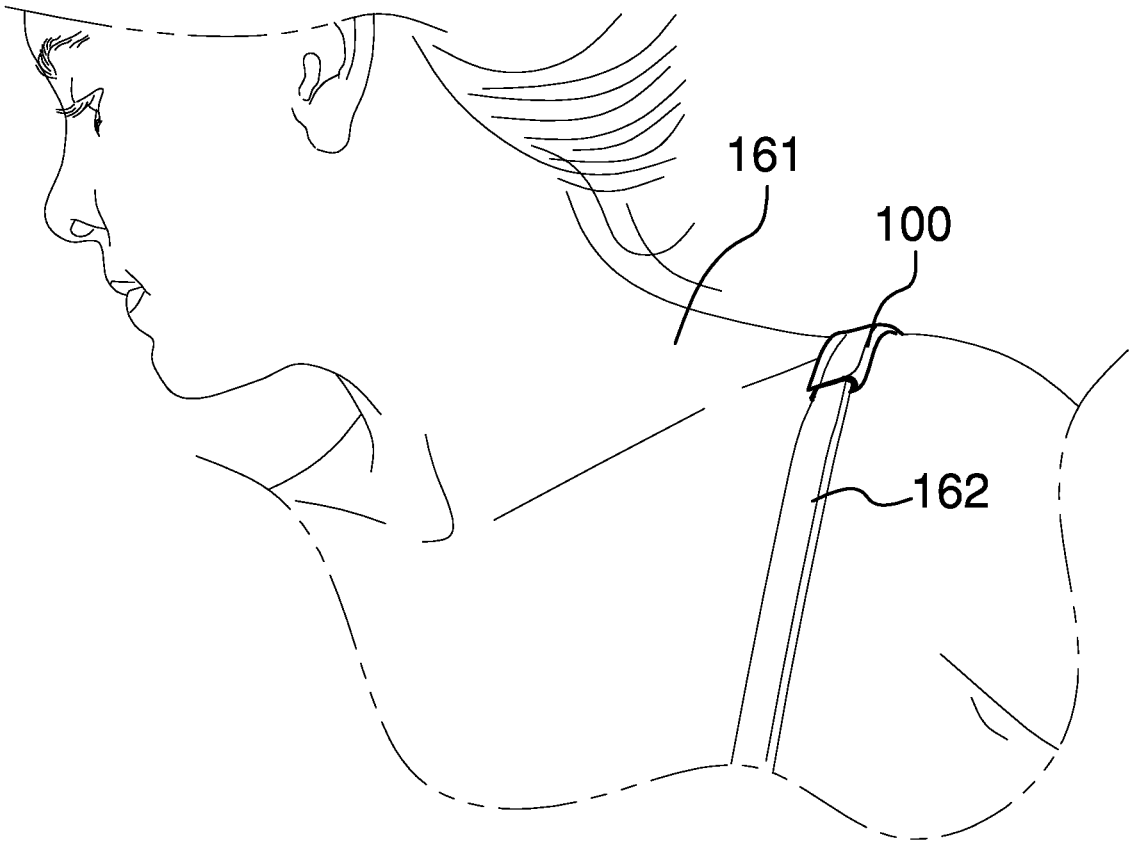
FIG. 5 is an in-use view of an embodiment of the disclosure.

Detailed reference will now be made to one or more potential embodiments of the disclosure, which are illustrated in FIGS. 1 through 5.

The bra strap holder 100 (hereinafter invention) is configured for use with a bra strap 162. The bra strap 162 is a webbing commonly used with a brassiere. The bra strap 162 is selected from the group consisting of a rigid structure or an elastic webbing. The bra strap 162 is worn over the shoulder of the person 161. The invention 100 is adapted for use with a person 161. The person 161 refers to an individual who is using the invention 100. The invention 100 is a clip that holds the bra strap 162 in a fixed position on the person 161. The invention 100 comprises a chevron 101 and an adhesive 102. The chevron 101 attaches to the bra strap 162. The adhesive 102 attaches the chevron 101 to the person 161.

The chevron 101 forms a clip that captures the bra strap 162. The chevron 101 is a cantilever V spring. The bra strap inserts into the chevron 101 such that the cantilever V spring formed by the chevron 101 captures the bra strap 162 while worn by the person 161. The chevron 101 comprises a first arm 111, a second arm 112, and a coupling 113. The chevron 101 is further defined with a capture gap 131, an interior surface 141, and an exterior surface 142.

The capture gap 131 is the space between the first arm 111 and the second arm 112. The bra strap 162 inserts into the capture gap 131 during normal use of the invention 100. The interior surface 141 comprises the surfaces of the chevron 101 that form the boundaries of the capture gap 131. The exterior surface 142 comprises the surfaces of the chevron 101 that are distal from the interior surface 141.

The first arm 111 is a cantilever structure that projects away from the coupling 113. The first arm 111 has a rectangular block structure. The second arm 112 is a cantilever structure that projects away from the coupling 113. The second arm 112 has a rectangular block structure.

The coupling 113 is a spring structure. The coupling 113 is selected such that the first arm 111 is closest to the second arm 112 when the coupling 113 is in its relaxed shape. The coupling 113 is a flexure bearing commonly referred to as a living hinge. The coupling 113 has a hyoid shape. The coupling attaches the first arm 111 to the second arm 112 such that the first arm 111 rotates towards and away from the second arm 112.

As used in this disclosure, the chevron 101 is a torsion spring. The chevron 101 comprises a first cantilever structure, referred to as the first arm 111, and a second cantilever structure, referred to as the second arm 112, wherein the fixed end of the first arm 111 and the fixed end of the second arm 112 attach to the coupling 113. Within this structure, when a force is applied to the chevron 101 such that the first arm 111 moves relative to the second arm 112 the force deforms the chevron 101 in an elastic manner that: 1) resists the application of the force; and 2) stores the energy of deformation such that when the force is no longer applied to then the chevron 101 then the chevron 101 returns to its relaxed shape. The insertion of the bra strap 162 into the capture gap 131 between the first arm 111 and the second arm 112: 1) displaces the first arm 111 relative to the second arm 112; and, 2) prevents the chevron 101 from fully returning to its relaxed position. By preventing the chevron 101 from returning to its relaxed position, the chevron 101 applies a force to the bra strap 162 that secures the bra strap 162 within the capture gap 131 of the chevron 101.

The adhesive 102 is a structure that adheres the chevron 101 to the skin of the person 161. The adhesive 102 is a removable adhesive. The adhesive 102 comprises an adhesive layer 121 and a protective sheeting 122.

The adhesive layer 121 is a chemical substance applied as a coating to the exterior surface 142 of the second arm 112. The adhesive layer 121 adheres the chevron 101 to the skin of the person 161 when the adhesive layer 121 is placed against the skin. The adhesive layer 121 fixes the chevron 101 in position on the person 161. By fixing the chevron 101 into a position, the bra strap 162 contained within the capture gap 131 of the chevron 101 is also fixed in position.

The applicant prefers that the selected adhesive layer 121 be suitable for applying cosmetic prosthetic devices to a person 161. The applicant prefers that the adhesive layer 121 is selected from the group consisting of spirit gum or a liquid cosmetic latex product such as flesh latex.

The protective sheeting 122 is a sheeting. The protective sheeting 122 is formed from a silicone impregnated paper such as culinary parchment paper. The protective sheeting 122 is placed over the adhesive layer 121 such that the protective sheeting forms a barrier between the adhesive layer 121 and the environment. The protective sheeting 122 prevents the adhesive layer 121 from accumulating detritus before use. The protective sheeting 122 is removed before the adhesive layer 121 is placed on the skin of the person 161.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Cantilever V Spring: As used in this disclosure, a cantilever V spring is a torsion spring formed in a chevron shape. The cantilever V spring comprises a first cantilever structure and a second cantilever structure wherein the fixed end of the first cantilever structure is attached to the fixed end of the second cantilever structure. Within this structure, when a force is applied to the cantilever V spring such that the first cantilever structure moves relative to from the second cantilever structure the force deforms the cantilever V spring in an elastic manner that: 1) resists the application of the force; and 2) stores the energy deformation such that when the force is no longer applied the cantilever V spring returns to its relaxed shape. Depending on the application, a cantilever V spring can be considered a torsion spring, a tension spring, or a compression spring.

Chevron: As used in this disclosure, chevron is a term that is used to describe an object that has the shape of a U or a V.

Clip: As used in this disclosure, a clip is a fastener that attaches to an object by gripping or clasping the object. A clip is typically spring loaded.

Coating: As used in this disclosure, a coating refers to a substance applied to the exterior surface of an object such that the coating forms a new exterior surface of the object. A coating is commonly said to be formed as a layer. Paint is an example of a common coating material.

Detritus: As used in this disclosure, detritus refers to an accumulation of unwanted material on a surface.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Flexure Bearing: As used in this disclosure, a flexure bearing is a thin and flexible material that is used to attach, or bind, a first object to a second object such that the first object can rotate in a controlled direction relative to the second object.

Hyoid: As used in this disclosure, a hyoid refers to a three-sided structure comprising a crossbeam, a first arm and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Living Hinge: As used in this disclosure, refers to a semi-rigid structure formed out of elastomeric material. The living hinge divides into a first segment, a second segment, and the living hinge. The elastic nature of the elastomeric material allows the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Relaxed Shape: As used in this disclosure, a structure is considered to be in its relaxed state when no shear, strain, or torsional forces are being applied to the structure.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Silicone: As used in this disclosure, silicone is a substance formed from silicon (Si) and oxygen (O) that forms the backbone of polymer type chains similar to polymers that are formed by carbon. Though exceptions do exist, silicone is generally considered to be less reactive and to have better heat resistance when compared to most common carbon-based polymers.

Sheeting: As used in this disclosure, a sheeting is a material, such as a textile, a plastic, or a metal foil, in the form of a thin flexible layer or layers.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Tack: As used in this disclosure, tack refers to a measure of the bonding strength of an adhesive. The greater the bonding strength, the more tack the adhesive is said to have.

Tension Spring: As used in this disclosure, a tension spring, also commonly referred to as an extension spring, is a wire coil that resists forces attempting to pull the wire coil in the direction of the center axis of the wire coil. The tension spring will return to its original position when the pulling force is removed.

Textile: As used in this disclosure, a textile is a material that is woven, knitted, braided or felted. Synonyms in common usage for this definition include fabric and cloth.

Torsion Spring: As used in this disclosure, a torsion spring is a mechanical device that stores mechanical energy through an opposing torque when the mechanical device is twisted. The torsion spring will return to its original relaxed shape when the twisting force is removed.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A stay clip for use with a brassiere comprising:
said stay clip comprises a cantilever V spring and an adhesive;
wherein the cantilever V spring attaches to a bra strap;
wherein the bra strap is selected from the group consisting of a rigid structure and an elastic webbing;
wherein the stay clip holds the bra strap in a fixed position on the person;
wherein the adhesive is a structure that is adapted to adhere the cantilever V spring to a skin surface of the person; and
wherein the adhesive is a removable adhesive.

2. The stay clip for use with a brassiere according to claim 1
wherein the cantilever V spring comprises a first arm, a second arm, and a coupling;
wherein the coupling attaches the first arm into the second arm;
wherein the cantilever V spring is further defined with a capture gap, an interior surface, and an exterior surface; and
wherein the capture gap is a space between the first arm and the second arm.

3. The stay clip for use with a brassiere according to claim 2
wherein the first arm is a cantilever structure that projects away from the coupling; and
wherein the second arm is a cantilever structure that projects away from the coupling.

4. The stay clip for use with a brassiere according to claim 3
wherein the first arm has a rectangular block structure; and
wherein the second arm has a rectangular block structure.

5. The stay clip for use with a brassiere according to claim 4
wherein the coupling is a spring structure; and
wherein the coupling is selected such that the first arm is closest to the second arm when the coupling is in its relaxed shape.

6. The stay clip for use with a brassiere according to claim 5
wherein the coupling is a living hinge; and
wherein the coupling has a hyoid shape.

7. The stay clip for use with a brassiere according to claim 6
wherein the coupling attaches the first arm to the second arm such that the first arm rotates towards and away from the second arm.

8. The stay clip for use with a brassiere according to claim 7 wherein the first arm moves relative to the second arm such that the cantilever V spring deforms in an elastic manner; and wherein when no force is applied to the cantilever V spring the cantilever V spring returns to its relaxed shape.

9. The stay clip for use with a brassiere according to claim 8 wherein the bra strap inserts into the capture gap;

wherein the insertion of the bra strap into the capture gap displaces the first arm relative to the second arm; and wherein the insertion of the bra strap into the capture gap prevents the chevron from fully returning to its relaxed position.

10. The stay clip for use with a brassiere according to claim 9 wherein the adhesive comprises an adhesive layer and a protective sheeting;

wherein the protective sheeting attaches to the adhesive layer;

wherein the adhesive layer is applied as a coating to an exterior surface of the second arm;

wherein the adhesive layer adheres the chevron to the skin of the person when the adhesive layer is placed against the skin; and wherein the adhesive layer fixes the chevron in position on the person.

11. The stay clip for use with a brassiere according to claim 10 wherein the protective sheeting is a sheeting;

wherein the protective sheeting is formed from a silicone impregnated paper; and wherein the protective sheeting is placed over the adhesive layer such that the protective sheeting forms a barrier over the adhesive layer.

12. The stay clip for use with a brassiere according to claim 11 wherein the adhesive layer is selected from the group consisting of spirit gum or a liquid cosmetic latex product.

13. A stay clip for use with a brassiere comprising:

said stay clip comprises a cantilever V spring and an adhesive;

wherein the stay clip is adapted to hold the bra strap in a fixed position on a person;

wherein the adhesive is a removable adhesive;

wherein the adhesive comprises an adhesive layer and a protective sheeting;

wherein the protective sheeting attaches to the adhesive layer;

wherein the adhesive layer is applied as a coating to an exterior surface of the cantilever V spring;

wherein the protective sheeting is formed from a silicone impregnated paper; and wherein the adhesive layer is selected from the group consisting of spirit gum or a liquid cosmetic latex product.

14. The stay clip for use with a brassiere according to claim 13 wherein the cantilever V spring comprises a first arm, a second arm, and a coupling;

wherein the coupling attaches the first arm into the second arm;

wherein the cantilever V spring is further defined with a capture gap, an interior surface, and the exterior surface; and wherein the capture gap is a space between the first arm and the second arm.

15. The stay clip for use with a brassiere according to claim 14 wherein the first arm is a cantilever structure that projects away from the coupling;

wherein the second arm is a cantilever structure that projects away from the coupling;

wherein the first arm has a rectangular block structure; and wherein the second arm has a rectangular block structure.

16. The stay clip for use with a brassiere according to claim 15 wherein the coupling is a torsion spring;

wherein the coupling is selected such that the first arm is closest to the second arm when the coupling is in its relaxed shape;

wherein the coupling is a living hinge;

wherein the coupling has a hyoid shape; and wherein the coupling attaches the first arm to the second arm such that the first arm rotates towards and away from the second arm.

17. The stay clip for use with a brassiere according to claim 16 wherein the first arm moves relative to the second arm such that the cantilever V spring deforms in an elastic manner; and wherein when no force is applied to the cantilever V spring the cantilever V spring returns to its relaxed shape.

18. The stay clip for use with a brassiere according to claim 17 wherein the bra strap inserts into the capture gap;

wherein the insertion of the bra strap into the capture gap displaces the first arm relative to the second arm; and wherein the insertion of the bra strap into the capture gap prevents the cantilever V spring from fully returning to its relaxed position.

* * * * *